US005178798A

United States Patent [19]

Jolicoeur

[11] Patent Number: 5,178,798

[45] Date of Patent: Jan. 12, 1993

[54] FORMATION OF DETERGENT GRANULES BY DEAGGLOMERATION OF DETERGENT DOUGH

[75] Inventor: John M. Jolicoeur, Cincinnati, Ohio

[73] Assignee: The Procter & Gamble Company, Cincinnati, Ohio

[21] Appl. No.: 786,649

[22] Filed: Nov. 1, 1991

Related U.S. Application Data

[63] Continuation-in-part of Ser. No. 649,127, Jan. 29, 1991, abandoned, which is a continuation of Ser. No. 364,725, Jun. 9, 1989, abandoned.

[51] Int. Cl.[5] ..... C11D 11/00

[52] U.S. Cl. ..... 252/553; 252/174; 252/174.25; 252/174.23; 252/174.24; 252/550; 252/558; 252/559; 252/174.21; 252/DIG. 2; 252/135

[58] Field of Search ..... 252/174, 174.25, 174.23, 252/174.24, 550, 553–558, 559, 174.21, DIG. 2, 135

[56] References Cited

U.S. PATENT DOCUMENTS

| | | | |
|---|---|---|---|
| 4,153,625 | 5/1979 | Barton et al. | 260/457 |
| 4,162,994 | 7/1979 | Kowalchuk | 252/550 X |
| 4,253,993 | 3/1981 | Ramsey, III et al. | 252/550 X |
| 4,261,917 | 4/1981 | Hayashi et al. | 252/550 X |
| 4,534,879 | 8/1985 | Iding et al. | 252/174 |
| 4,692,271 | 9/1987 | Messenger et al. | 252/354 |
| 4,753,754 | 6/1988 | Messenger et al. | 252/354 |
| 4,869,843 | 9/1989 | Saito et al. | 252/174.25 X |
| 4,925,585 | 5/1990 | Strauss et al. | 252/174 X |
| 4,970,017 | 11/1990 | Nakamura et al. | 252/174.25 X |

FOREIGN PATENT DOCUMENTS

| | | |
|---|---|---|
| 60-072999 | 4/1985 | Japan . |
| 61-231099 | 10/1986 | Japan . |
| 62-045696 | 2/1987 | Japan . |
| 2-218656 | 8/1990 | Japan . |

*Primary Examiner*—W. J. Shine
*Assistant Examiner*—Douglas J. McGinty
*Attorney, Agent, or Firm*—Kathleen M. Harleston; Donald E. Hasse; Ronald L. Hemingway

[57] ABSTRACT

The present invention provides a process for making detergent granules by forming a doughy mass comprising surfactant and/or water-soluble organic polymer and/or detergent builder, and then granulating by mixing a deagglomerating agent into the doughy mass at a high shear rate. Neutral or alkaline salt, detergent builder and other conventional detergent ingredients can be, and preferably are, kneaded into the doughy mass before addition of the deagglomerating agent. The deagglomerating agent is a fine powder having a mean particle size of less than about 200 microns and is most preferably sodium aluminosilicate.

25 Claims, No Drawings

FORMATION OF DETERGENT GRANULES BY DEAGGLOMERATION OF DETERGENT DOUGH

REFERENCE TO RELATED APPLICATION

This application is a Continuation-in-Part of U.S. patent application Ser. No. 649,127 filed Jan. 29, 1991, abandoned, which was a continuation of U.S. patent application Ser. No. 364,725 filed Jun. 9, 1989, abandoned.

FIELD OF INVENTION

The present invention relates to a process for preparing detergent granules, and to detergent granules made by this process. More particularly, this invention relates to a process for making detergent granules by forming a doughy mass comprising water and surfactant and/or water-soluble organic polymer and/or detergent builder, and then granulating by mixing the doughy mass with a deagglomerating agent at a high shear rate. Neutral or alkaline salt, detergent builder and other conventional detergent ingredients can be, and preferably are, kneaded into the doughy mass before addition of the deagglomerating agent. The deagglomerating agent is a fine powder having a mean particle size of less than about 200 microns and is most preferably sodium aluminosilicate.

BACKGROUND OF THE INVENTION

There is currently interest in the detergent industry in concentrated detergent products. These products provide advantages to the consumer, who has a product which can be used in lower amounts and is more easily stored, and to the producer and intermediates, who have lower transportation and warehousing costs. A major difficulty, though, is finding a relatively inexpensive and efficient way to produce a condensed detergent granule for inclusion in a concentrated detergent product.

The traditional method for producing detergent granules is spray drying. Typically, detergent ingredients such as surfactant, builder, silicates and carbonates are mixed in a mix tank to form a slurry which is about 35% to 50% water. This slurry is then atomized in a spray drying tower to reduce moisture to below about 10%. It is possible to compact spray dried particles to make dense detergent granules. See U.S. Pat. No. 4,715,979, Moore et al., issued Dec. 29, 1987. However, the use of spray drying to make condensed granules has some disadvantages. Spray drying is energy intensive and the resulting granules are typically not dense enough to be useful in a concentrated detergent product. Spray drying methods generally involve a limited amount (less than 40%) of organic components such as surfactant for environmental and safety reasons.

Other technologies for producing a dense detergent granule are described in the following patent applications.

Japanese Patent 61-118500, Hara et al., laid open Jun. 5, 1986, discloses a method for the manufacture of concentrated detergent compositions characterized by kneading the materials of the detergent composition continuously, and feeding these materials, which contain at least 30% by weight of surfactant, into an air-tight-type kneader with a controlled pressure of 0.01–5 $kg/cm^2G$.

Japanese Patent 62-263299, Nagai et al., laid open Nov. 16, 1987, discloses a method for the preparation of granular nonionic detergent compositions by first forming a solid detergent by kneading and mixing uniformly a raw material mixture consisting of 20–50 weight % of nonionic surfactant, which is a liquid or a paste, at a temperature not about 40° C. and 50–80 weight % of a mixture of (A) a zeolite, and (B) a lightweight sodium carbonate in the ratio of (A)/(B)=75/25–25/75 by weight, followed by granulation of the solid detergent. Mechanical granulation (grinding) follows the kneading step.

Japanese Patent 61-231099, Sai et al., laid-open Oct. 15, 1986, discloses concentrated powdered detergents containing (a) anionic surfactant, (b) polycarboxylic acid polymer or their salts, (c) polyethylene glycol, wherein the amount of (a) is 25–50% by weight and the total amount of (b) and (c) is 2–10% by weight, while the ratio of (b) to (c) is ⅓ to 6/1. The detergent also contains 0–10% by weight of a water-soluble neutral inorganic salt. A grinding process for obtaining the product is mentioned (page 7).

Japanese Patent 60-072999, Satsusa et al., laid open Apr. 25, 1985, discloses a production method for a highly concentrated powder detergent where sulfonate and/or sulfate is mixed with sodium carbonate and water in a high shear mixer, cooled below 40° C., and then pulverized with a zeolite powder and other detergent components.

Japanese Patent 62-45696, Mukoyama et al, laid open Feb. 27, 1987, disclosed a dense granular detergent composition made by mixing and pulverizing a detergent composition which is then coated with water-insoluble micropowder (5–35% zeolite).

Certain problems are associated with using mechanical methods such as grinding, crushing or extruding to form detergent granules. As the temperature in the grinding, crushing or extruding mechanism rises, buildup, smearing and sieve screen blinding can occur. Humid air conditions can also increase buildup of the detergent materials in the equipment. These problems generally are worse with higher levels of organic material in the composition.

U.S. Pat. No. 4,515,707, Brooks, issued May 7, 1985 discloses anhydrous fatty alcohol sulfuric acid or ethoxylated fatty alcohol sulfuric acid which is neutralized with dry sodium carbonate powder in the presence of powdered sodium tripolyphosphate in a high shear mixer. The dry, powdered, neutralized reaction product is stored until require for use in the manufacture of a detergent bar whereupon the powder is mixed with liquid ingredients for the detergent bar and subjected to conventional manufacturing steps for a detergent bar.

Canadian Patent 1070210, Schoenholz et al, issued Jan. 22, 1980 discloses a dry blended, concentrated detergent composition of a surfactant compound and a dense powdery composition consisting essentially of a certain carbonate and from 0 to 40% other miscellaneous additives.

European Patent Application 266847-A disclosed production of an organic acid containing, pliable, pasty detergent composition comprising dry mixing a linear alkyl benzene sulphonic acid with sodium carbonate, neutralizing the mixture with caustic solution to form a pasty mass, and blending with active organic acid and filler. It is said that these compositions are useful for incorporation into multiple use scrubbing pads for bathroom use, etc., for removing soap scum and lime scale.

It is also said that the order of addition of components gives the desired pasty mass.

Pending U.S. patent application Ser. No. 213,575, Strauss et al., filed Jun. 29, 1988, now U.S. Pat. No. 4,925,585, relates to a process for making a free flowing granular detergent comprising (a) mixing an effective amount of an aqueous surfactant paste having a detergency activity of at least 40% and an effective amount of a dry detergency builder, said surfactant paste active and builder having a ratio of 0.05:1 to 1.5:1; (b) rapidly forming a uniform dough from said mix at a dough temperature of from about 15° C. to about 35° C.; (c) cooling said dough to a granulation temperature of from about −25° C. to about 20° C.; and (d) granulating said cooled dough into discrete detergent granules using fine dispersion mixing at a tip speed of about 5–50 m/sec.

Pending U.S. patent application 288,759, Strauss et al., filed Dec. 22, 1988, relates to a process for making concentrated surfactant granules from a high active surfactant paste using fine dispersion granulation. The process comprises:

A. mixing surfactant paste having about 50% detergency activity;
B. cooling the paste to a granulation temperature of about −65° to 25° C.;
C. granulating the cooled paste into discrete surfactant granules using fine dispersion mixing at a mixing tip speed of about 5–50 m/sec. for about 0.1 to 10 minutes.

SUMMARY OF THE INVENTION

The present invention relates to a process for making detergent granules, comprising:

(a) forming a doughy mass comprising a substantially uniform mixture of, by weight:
  (1) from about 5% to about 40% of water;
  (2) from about 20% to about 90% of an ingredient selected form the group consisting of anionic, zwitterionic, cationic, ampholytic, and nonionic surfactant; water-soluble organic polymer; detergent builder; and mixtures thereof;
  (3) from 0 to about 25% of a deagglomerating agent which is a fine powder having a mean particle size less than about 200 microns;
(b) mixing the doughy mass with an effective amount of a deagglomerating agent, which is a fine powder having a mean particle size of less than about 200 microns, in a high shear mixer at a tip speed of greater than about 10 meters per second and wherein the ratio of doughy mass to deagglomerating agent added in step (b) is from about 9:1 to about 1:5.

DESCRIPTION OF THE INVENTION

This invention includes a process for making detergent granules by forming a doughy mass of water and surfactant and/or water-soluble organic polymer and/or detergent builder, and then granulating the doughy mass with a deagglomerating agent in a high shear mixer. Detergent granules made by this process are also claimed.

The first step in the process is forming a doughy mass with the step (a) ingredients (described below).

The first ingredient in step (a) is water. Water levels in the doughy mass are restricted to between about 5% and about 40% (by weight) to assure that granulation occurs and the finished granule is not sticky. At higher water levels the doughy mass upon continued high shear mixing will incorporate the deagglomerating agent rather than be granulated by it. Water level in the doughy mass is preferably about 5% to about 20%, most preferably from about 5% to about 15%. Water level in the finished detergent granule should be less than about 20%, preferably less than about 15%, most preferably less than about 13%.

When the doughy mass is comprised of more than one ingredient other than water, the doughy mass is preferably formed by kneading together all the ingredients in step (a) (in any order) into a substantially uniform mixture, preferably at a temperature between about 35° C. and about 100° C. If the temperature of the doughy mass is too high, (above about 100° C.), then the doughy mass becomes too sticky and absorbs the deagglomerating agent during step (b) rather than being granulated by the agent. If a single ingredient doughy mass is used, such as sodium alkyl sulfate or water-soluble organic polymer, then it is not necessary to knead the doughy mass since the single ingredient serves as the doughy mass and already contains water. For the surfactants, such as linear alkylbenzene sulfonate and alkyl sulfate, neutralized product (a "single ingredient") may be used in or as the dough mass, or the surfactant may be neutralized in the mixer as part of the first step.

The preferred temperature range of the doughy mass is between about 40° and 80° C., and the most preferred range is between about 50° C. and 70° C. Temperatures that are too cold (less than about 35° C.) result in a doughy mass which is too viscous to be effectively broken up by the shearing of the mixer and the deagglomerating agent. Granulation of a cold doughy mass must be done using grinding equipment as has been described elsewhere. Also, cold temperature reduces the stickiness of the doughy mass, which prevents the deagglomerating agent from sticking to the outside of the forming particles during step (b). In the present process, it is believed that the deagglomerating agent coats the forming particles and suppresses reagglomeration of these particles, resulting in free-flowing, non-sticky particles.

Kneading is ordinarily carried out in a mixer, most conveniently in the high shear mixer necessary for the second step in the process. Examples of appropriate mixers are the Cuisinart® mixer, Lancaster® mixer and Eirich® Intensive Mixer. However, if desired, the doughy mass could be kneaded in a Sigma® mixer or extruder, for example, and then transferred to a high shear mixer such as the Eirich® Intensive Mixer for granulation (step (b) of the process). The speed of the mixer and duration of the kneading step varies depending on the kin of mixer and ingredients used. Kneading should be done at a speed and for a time sufficient to achieve a homogeneous doughy mass.

Not more than about 25%, preferably less than about 15%, and most preferably less than about 5% (by weight) of the doughy mass should be made up of deagglomerating agent. If more than about 25% is deagglomerating agent, then the doughy mass will not be of the proper consistency ( it will be quite viscous) to granulate when the deagglomerating agent is added in the second step.

The second step in the process is mixing the doughy mass formed by the first step with deagglomerating agent in a high shear mixer at a tip speed of greater than about 10 meters per second until granules are formed. The deagglomerating agent can be added all at once or, preferably, more slowly. Most preferred is addition over a period of about a minute. A tip speed less than bout 10 meters per second will not achieve a high enough shearing action to cause effective granulation. The appropriate tip speed should be chosen based on the consistency of the doughy mass and the type of high shear mixer. Preferred tip speed is greater than about 15 meters per second, most preferably between about 20 and 35 meters per second. Granulation usually occurs within a few minutes (about three to five minutes) of complete addition of the deagglomerating agent.

The ratio of doughy mass (step a) to deagglomerating agent added in step b is from about 9:1 to about 1:5, preferably from about 4:1 to about 1:2, most preferably from about 3:1 to about 1:1.

Ingredients of the first step are water and surfactant and/or water-soluble organic polymer and/or detergent builder, preferably a mixture of these. Neutral or alkaline salt and builder are optionally and preferably added. These can be combined in any order. Other conventional detergent ingredients can be, and preferably are, added in conventional amounts to the doughy mass.

The added ingredient of the second step is deagglomerating agent. The process ingredients, and dense detergent granules made by the process, are described as follows.

The doughy mass in step (a) comprises, by weight, from about 5% to about 40% of water; from about 20% to about 90%, preferably from about 25% to about 60%, most preferably from about 30% to about 50%, of an ingredient selected from the group consisting of anionic, zwitterionic, ampholytic, cationic, and nonionic surfactant; water-soluble organic polymer; organic builder; and mixtures thereof (preferred). The doughy mass in step (a) can also comprise from 0 to about 25% of deagglomerating agent.

The amount of surfactant, most preferably anionic surfactant, in the doughy mass can be limited to between about 20% and about 25% by weight, or preferably between about 50% and about 90% by weight, most preferably between about 60% and about 85% by weight. Where the lower end (about 20–25%) of anionic surfactant is employed, from about 50% to about 70% by weight of the detergent builder is also preferably included in the doughy mass.

The doughy mass is preferably not cooled before the deagglomerating step. As stated above, the doughy mass in step (b) is at a temperature between about 35° C. and about 100° C., more preferably between about 40° C. and about 100° C., more preferably between about 40° C. and about 80° C., most preferably between about 50° C. and about 70° C.

Step (a), forming the doughy m ass, and step (b), mixing the doughy mass with deagglomerating agent, do not include crushing. Crushing grinding and/or extruding steps are preferably not included herein. Additionally mechanical methods such as pelletizing are also not preferred.

A. Surfactant

Detergent surfactants can be, and preferably are, included herein. They can be selected from anionic, nonionic, nonionic, zwitterionic, ampholytic and cationic classes and compatible mixtures thereof. Detergent surfactants useful herein are listed in U.S. Pat. No. 3,664,961, Norris, issued May 23, 1972, and in U.S. Pat. No. 3,919,687, Laughlin et al., issued Dec. 30, 1975, both incorporated herein by reference. Useful cationic surfactants also include those describe din U.S. Pat. No. 4,222,905, Cockrell, issued Sep. 16, 1980, and in U.S. Pat. No. 4,239,659, Murphy issued Dec. 16, 1980, both incorporated herein by reference. Of the surfactants, anionics and nonionics are preferred and anionics are most preferred. The following are representative examples of detergent surfactants useful in the present granules.

Water-soluble salts of the higher fatty acids, i.e., "soaps", are useful anionic surfactants in the compositions herein. This includes alkali metal soaps such as the sodium, potassium, ammonium, and alkylolammonium slats of higher fatty acids containing from about 8 to about 24 carbon atoms, and preferably from about 12 to about 18 carbon atoms. Soaps can be made by direct sanctification of fats and oils or by the neutralization of free fatty acids. Particularly useful are the sodium and potassium salts of the mixtures of fatty acids, derived from coconut oil and tallow, i.e., sodium or potassium tallow and coconut soap.

Useful anionic surfactants also include the water-soluble salts, preferably the alkali metal, ammonium and alkylolammonium salts, or organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11-13}$ LAS.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing form about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from a bout 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Preferred anionic surfactants are $C_{10-18}$ linear alkylbenzene sulfonate and $C_{10-18}$ alkyl sulfate. If desired, low moisture (less than about 25% water)alkyl sulfate paste can be the sole ingredient in the doughy mass. Most preferred is a combination of the two. A preferred embodiment of the present invention is wherein the doughy mass comprises from about 20% to about 40% of a mixture of sodium $C_{10-13}$ linear alkylbenzene sulfonate and sodium $C_{12-16}$ alkyl sulfate in a ratio of about 2:1 to 1:2.

Water-soluble nonionic surfactants are also useful in the instant invention. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having eh desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 12 moles of ethylene oxide per mole of alkyl phenol.

Included are the water-soluble and water-dispersible condensation products of aliphatic alcohols containing from 8 to 22 carbon atoms, in either straight chain or branched configuration, with from 3 to 12 moles of ethylene oxide per mole of alcohol.

Semi-polar nonionic surfactants include water-soluble amino oxides containing one alkyl moiety of from about 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Preferred nonionic surfactants are of the formula $R^1(OC_2H_4)_nOH$, wherein $R^1$ is a $C_{10}$–$C_{16}$ alkyl group or a $C_8$–$C_{12}$ alkyl phenyl group, and n is from 3 to about 80.

Particularly preferred are condensation products of $C_{12}$–$C_{15}$ alcohols with from about 5 to about 20 moles of ethylene oxide pre mole of alcohol, e.g., $C_{12}$–$C_{13}$ alcohol condensed with about 6.5 moles of ethylene oxide per mole of alcohol.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants includes derivatives of aliphatic, quaternary, ammonium, phosphonium, and sulfonium compounds in which one of the aliphatic substituents contains from about 8 to 18 carbon atoms.

Cationic surfactants can also be included in the present invention. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Suitable anions are halides, methyl sulfate and hydroxide. Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980, incorporated herein by reference.

Cationic surfactants are often used in detergent compositions to provide fabric softening and/or antistatic benefits. Antistatic agents which provide some softening benefit and which are preferred herein are the quaternary ammonium slats described in U.S. Pat. No. 3,936,537, Baskerville, Jr. et al., issued Feb. 3, 1976, which is incorporated herein by reference.

It is particularly preferred that from about 20% to about 40% by weight of the doughy mass is anionic surfactant, more preferably mixtures of $C_{10-18}$ (most preferably $C_{10-13}$) linear alkylbenzene sulfonate and $C_{10-18}$ (most preferably $C_{12-16}$) alkyl sulfate in a ratio of about 2:1 to 1:2, and that from 0% to about 10% by weight of the doughy mass is nonionic surfactant, preferably condensation products of $C_{12-15}$ alcohols with from about five to about 20 moles of ethylene oxide per mole of alcohol.

B. Water-Soluble Organic Polymer

The doughy mass in step (a) can, and preferably does, also comprise water-soluble organic polymer.

Suitable polymers herein include homopolymers and copolymers of unsaturated aliphatic mono- or polycarboxylic acids. Preferred carboxylic acids are acrylic acid, hydroxyacrylic acid, methacrylic acid, maleic acid, fumaric acid, itaconic acid, aconitic acid, crotonic acid, and citroaconic acid. The polycarboxylic acids (e.g. maleic acid) can be polymerized in the form of their anhydrides and subsequently hydrolyzed. The copolymers can be formed of mixtures of the unsaturated carboxylic acids with or without other copolymerizable monomers, or they can be formed from single unsaturated carboxylic acids with other copolymerizable monomers. In either case, the percentage by weight of the polymer units derived from noncarboxylic acids is preferably less than about 50%. Suitable copolymerizable monomers include, for example, vinyl chloride, vinyl alcohol, furan, acrylonitrile, vinyl acetate, methyl acrylate, methyl methacrylate, styrene, vinyl methyl ether, vinyl ethyl ether, vinyl propyl ether, acrylamide, ethylene, propylene and 3-butenoic acid.

Homo- and copolymers of sulfonates, sulfates and phosphates of suitable monomers such as styrene, vinyl alcohol, vinyl chloride, etc., are particularly useful in the practice of the invention. Polystyrene sulfonate with a molecule weight in the range of from about 2000 to about 6000 is particularly useful in the practice of the invention.

Other preferred polymers are the homopolymers and copolymers of acrylic acid, hydroxyacrylic acid, or methacrylic acid, and salts thereof, which in the case of the copolymers contain at least about 50%, and preferably at least about 80%, by weight of units derived from the acid. Particularly preferred polymers are sodium polyacrylate and sodium polyhydroxyacrylate. The most preferred is sodium polyacrylate. Other specific preferred polymers are the homopolymers and copolymers of maleic anhydride, especially the copolymers with ethylene, styrene and vinyl methyl ether. These polymers are commercially available under trade names such as Gantrez AN.

The polymerization of acrylic acid homo- and copolymers can be accomplished using free-radical initiators, such as alkali metal persulfates, acyl and aryl peroxides, acyl and aryl peresters and aliphatic azocompounds. The reaction can be carried out in situ or in aqueous or nonaqueous solutions or suspensions. Chain-terminating agents can be added to control the molecular weight. The copolymers of maleic anhydride can be synthesized using any of the types of free-radical initiators mentioned above in suitable solvents such as benzene or acetone, or in the absence of a solvent, under an inert atmosphere. These polymerization techniques are well known in the art. It will be appreciated that instead of using a single polymeric aliphatic carboxylic acid, mixtures of two or more polymeric aliphatic carboxylic acids can be used to prepare the above polymers.

In general, natural polymers such as pectin, alginic acid, gum arabic and carragheenan and cellulose derivatives such as cellulose sulfate, carboxymethyl cellulose, hydroxypropyl cellulose and hydroxybutyl cellulose are not particularly effective in the practice of the invention. Vinyl polymers without sufficient ionizable sites are likewise not particularly effective.

Preferred water-soluble organic polymer ar polyacrylates, and polyacrylate-maleic blends, of molecular weight between about 4,000 and 100,000 and polyethylene glycol of molecular weight between about 2,000 and 50,000 (most preferred). Particularly preferred is polyethylene glycol of molecular weight between about 4,000 and 10,000.

C. Detergent Builder

The doughy mass in step (a) can, and preferably does, also comprise a third ingredient: water-soluble detergent builder.

Builders are generally selected from the various water-soluble, alkali metal, ammonium or substituted ammonium phosphates, polyphosphates, phosphonates, polyphosphonates, carbonates, silicates, borates, polyhdyroxy sulfonates, polyacetates, carboxylates, and polycarboxylates. Preferred are the alkali metal, especially sodium, salts of the above.

Preferred for use herein are the phosphates, carbonates, silicates, $C_{10-18}$ fatty acids, polycarboxylates, and mixtures thereof. More preferred are sodium tripolyphosphate, tetrasodium pyrophosphate, citrate, tartrate mono- and di-succinates, sodium silicate, and mixtures thereof (see below).

Specific examples of inorganic phosphate builders are sodium and potassium tripolyphosphate, pryophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1 1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, incorporated herein by reference.

Examples of nonphosphorus, inorganic builders are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4.

Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehl, issued Mar. 7, 1967, incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid. Some of these materials are useful as the water-soluble anionic polymer as hereinafter described, but only if in intimate admixture with the non-soap anionic surfactant.

Other useful builders herein are sodium and potassium carboxymethyloxymalonate, carboxymethlyoxysucciniate, cis-cyclohexanehexacarboxylate, cis-cyclopentanetetracarboxylate, phloroglucinol trisulfonate, and the copolymers of maleic anhydride with vinyl methyl ether or ethylene.

Other suitable polycarboxylates for use herein are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition.

Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, incorporated herein by reference.

Water-soluble silicate solids represented by the formula $SiO_2.M_2O$, M being an alkali metal, and having a $SiO_2:M_2O$ weight ratio of from about 0.5 to about 4.0, are useful salts in the compositions of the invention at levels of from about 2% to about 15% on an anhydrous weight basis, preferably from about 3% to about 8%. Anhydrous or hydrated particulate silicate can be utilized.

D. Other Detergent Ingredients

The doughy mass of the present invention can, and preferably does, contain from 0 to about 50%, by weight of the detergent granules, of other conventional detergent ingredients commonly used in laundry or cleaning products such as water-soluble neutral or alkaline salt.

These detergent ingredients can also include suds boosters or suds suppressors, anti-tarnish and anticorrosion agents, soil suspending agents, soil release agents, germicides, pH adjusting agents, non-builder alkalinity sources, chelating agents, smectite clays, enzyme-stabilizing agents and perfumes. See U.S. Pat. No. 3,936,537, issued Feb. 3, 1976 to Baskerville, Jr. et al., incorporated herein by reference. Bleaching agents and activators are described in U.S. Pat. No. 4,412,934, Chung et al., issued Nov. 1, 1983, and in U.S. Pat. No. 4,483,781, Harment, issued Nov. 20, 1984, both of which are incorporated herein by reference.

Preferred additional detergent ingredients are germicide, soil release agent, soil suspending agent, and pH adjusting agent. Other additional detergent ingredients, such as bleaching agent, enzyme, and suds control agent, can be admixed with the finished detergent granules. Fluorescent brighteners, which are known in the art, can, and preferably are, also included in the doughy mass.

The doughy mass of the present invention can, and preferably does, contain from 0 to about 50%, preferably from about 1% to about 20%, and more preferably from about 2% to about 15%, by weight of water-soluble neutral or alkaline salt. The neutral or alkaline salt has a pH in solution of seven or greater, and can be either organic or inorganic in nature. The salt assists in providing the desired density and bulk to the detergent granules herein. While some of the salts are inert, many of them also function as a detergency builder.

Sodium and potassium salts are particularly useful for reasons of coast and physical properties. Suitable salts may be inorganic or organic, monomeric or polymeric.

Examples of neutral water-soluble salts include the alkali metal, ammonium or substituted ammonium chlorides and sulfates. The alkali metal, and especially sodium, salts of the above are preferred. Sodium sulfate is typically used in detergent granules and is a particularly preferred salt herein.

Buffering agents can be utilized to maintain the desired alkaline pH of the bleaching solutions.

Preferred optional ingredients include suds modifiers, particularly those of suds suppressing types, exemplified by silicones, and silica-silicone mixtures. U.S. Pat. No. 3,933,672, issued Jan. 20, 1976 to Bartolotta et al, and U.S. Pat. No. 4,136,045, issued Jan. 23, 1979 to Gault et al., incorporated herein by reference, disclose silicone suds controlling agents. Particularly useful suds suppressors are the self-emulsifying silicone suds suppressors, described in U.S. Pat. No. 4,073,118, Gault et al., issued Feb. 21, 1978, incorporated herein by reference.

Suds modifiers as described above are used at levels of up to approximately 2%, preferably from about 0.1 to about 1-½%, by weight of the surfactant.

Additional examples of preferred suds control components for use in the subject compositions are alkyl phosphate esters, and microcrystalline waves having a melting point in the range of 35° C.-115° C. and a saponification value of less than 100. The latter are described in detail in U.S. Pat. No. 4,056,481, Tate, issued Nov. 1, 1977, incorporated herein by reference. Other suds control agents useful in the practice of the invention are the soap or the soap and nonionic mixtures disclosed in U.S. Pat. No. 2,954,347, St. John et al., and U.S. Pat. No. 2,954,348, Schwoeppe, both issued Sep. 27, 1960 and incorporated herein by reference.

E. Deagglomerating Agent

The second step of the instant process is mixing the doughy mass formed by step (a) in a ratio of from about 9:1 to about 1:5, preferably from about 4:1 to about 1:2, most preferably from about 3:1 to about 1:1, of a deagglomerating agent which is a fine powder having a mean particle size of less than about 200 microns, preferably less than about 100 microns, more preferably less than about 50 microns, most preferably less than about 10 microns. This is done in a high shear mixer at a tip speed of greater than about 10 meters per second until detergent granules are formed.

Preferred deagglomerating agents are selected from the group consisting of aluminosilicate, powdered tripolyphosphate, powdered tetrasodium pyrophosphate, citrate, powdered carbonate, sulfate, and mixtures thereof. More preferred deagglomerating magnets are selected from the group consisting of sodium aluminosilicate, powdered sodium tripolyphosphate, powdered tetrasodium pyrophosphate, and mixtures thereof. Most preferred is sodium aluminosilicate.

The most preferred deagglomerating agent herein is a water-insoluble crystalline (or amorphous) aluminosilicate ion exchange material. The preferred crystalline material useful herein is of the formula $$Na_z[(AlO_2)_z/)SiO_2)_y].xH_2O$$

wherein z and y are at least about 6, the molar ratio of z to y is from about 1.0 to about 0.5 and x is from about 10 to about 264. Amorphous hydrated aluminosilicate materials useful herein have the empirical formula $$M_z(zAlO_2.ySiO_2)$$

wherein M is sodium, potassium, ammonium or substituted ammonium, z is from about 0.5 to about 2 and y is 1, said material having a magnesium ion exchange capacity of at least about 50 milligram equivalents of $CaCO_3$ hardness per gram of anhydrous aluminosilicate.

Granulation occurs almost immediately after addition of the deagglomerating agent to the doughy mass under high shear. Without meaning to be bound by theory, it is believed that the doughy mass is granulated in the high shear mixer because of the shearing action of the mixer and the deagglomerating and coating properties of the deagglomerating agent. The resulting detergent granules are dense and free-flowing. The particle size distribution of the resulting detergent granules is ordinarily from about 100 to about 1200 microns, with the mean particle size being about 400 microns. The particles can be and preferably are screened to remove particles of greater than about 1200 microns in diameter. Bulk densities for particles made by this process range from about 500 to about 1200 grams per liter and are typically between about 650 and about 850 grams per liter, depending upon the composition. Note that the "mean particle size" refers to individual particles and not particle agglomerates.

The detergent granules formed by this process can be used alone as a full detergent formulation or as an admix in granular cleaning products. For example, high surfactant detergent granules made by this process can be admixed with detergent base granules (spray-dried, for example) to increase surfactant levels of the product. High builder detergent granules made by this process can be admixed in a granular hard surface cleaner, granular bleaching product, or detergent product to increase builder levels.

The following examples are given to illustrate the parameters of and compositions within the invention. All percentages, parts and ratios are by weight unless otherwise indicated.

EXAMPLE I

The following granular detergent composition is prepared.

| Ingredient | Weight Percent Finished Product | Dough |
|---|---|---|
| Sodium $C_{12}$ linear alkylbenzene sulfonate | 12.13 | 20.32 |
| Sodium $C_{14-15}$ alkyl sulfate | 12.13 | 20.32 |
| $C_{12-13}$ alcohol polyethoxylate (6.5) | 1.18 | 1.98 |
| Sodium aluminosilicate | 30.63 | — |
| Sodium polyacrylate (MW = 4500) | 3.73 | 6.25 |
| Sodium carbonate | 18.02 | 27.49 |
| Sodium silicate (2.0) | 2.6 | 4.36 |
| Polyethylene glycol (MW = 8000) | 1.310 | 2.19 |
| Water | 15.29 | 12.11 |
| Fluorescent brightener, miscellaneous | Balance | Balance |

Dough: Deagglomerating Agent Ratio 1.48:1

The above detergent composition is prepared using the following method in a Eirich® Intensive Mixer. About 5 kg. of the composition is made as described below.

A. $NaC_{12}LAS$ is first formed from the dry neutralization of the dodecylsulfonic acid with light (fine particle size) soda ash (carbonate). The Eirich mixer is charged with the fine grade, light soda ash. Dodecylsulfonic acid (@140° F.; 60° C.) is then added to the fine soda ash. The resulting mass is then mixed for 35 seconds to allow the dry neutralization to begin and initiate the formation of a doughy mass.

B. Sodium alkyl sulfate is added to the soda ash and dodecylsulfonic acid, and mixed to form a doughy mass. The sodium alkyl sulfate is added as low moisture paste (75%) alkyl sulfate, 11% water, 8% polyethylene glycol, 6% miscellaneous) at 140° F. (60° C.). The mixing time for this step of the process is 75 seconds.

C. To the mixture of step B, the liquid ingredients ($C_{12-13}$ alcohol polyethoxylate and polyacrylate MW=4500—55% aqueous) are added. The liquids are mixed into the dough mass for 45 seconds.

D. To the doughy mass from step C, the minor powdered detergent ingredients (neutralized fatty acid, sodium silicate, fluorescent brightener) are added and mixed into the doughy mass for 30 seconds.

The doughy mass comprises approximately 12% water, and 83% of an ingredient selected from the group consisting of anionic, zwitterionic, cationic, ampholytic, and nonionic surfactant; water-soluble organic polymer; and/or detergent builder.

E. The doughy mass formed in steps A–D (which has about 12% water) is then granulated using sodium aluminosilicate (SAS) powder. Hydrated zeolite A is the SAS used. It has an average particle diameter of from 32 to 5 microns. The SAS is added to the doughy mass over a period of 45 seconds. The tip speed for the rotor of the Eirich mixer is 33 m/sec during the addition of the deagglomerating agent (SAS). The mass is then post-mixed for approximately 3 minutes to allow the dough granulation to complete.

The resulting detergent granules are screened to select a through 14 Tyler mesh (about 1180 microns) on 100 Tyler mesh (150 microns) particle size cut. The through 14 on 100 Tyler mesh particle size cut has a bulk density of 700 g/L.

EXAMPLES II and III

The following granular detergent compositions are prepared.

| Ingredient | Weight Percent Finished Product | Dough |
|---|---|---|
| Sodium $C_{14-15}$ alkyl sulfate | 13.8 | 71.4 |
| Sodium aluminosilicate | 61.3 | — |
| Water | 20.0 | 20.0 |
| Polyethylene glycol (MW = 8000) | 0 | — |
| Others (unreacted alcohol, sulfate, carbonate impurities) | 5.9 | 8.6 |

Dough: Deagglomerating Agent Ratio 1:4.12

EXAMPLE III

| Ingredient | Weight Percent Finished Product | Dough |
|---|---|---|
| Sodium $C_{14-15}$ alkyl sulfate | 59.3 | 72.9 |
| Sodium aluminosilicate | 14.2 | — |
| Water | 12.7 | 11.0 |
| Polyethylene glycol (MW = 8000) | 8.1 | 10.0 |
| Others (unreacted alcohol, sulfate, carbonate impurities) | 5.7 | 6.1 |

Dough: Deagglomerating Agent Ratio 4.35:1

The detergent composition in Example II is prepared as follows in a Cuisinart® DLC-10 Plus Food Processor. The Cuisinart® is set at a rotor tip speed of 14.3 m/sec. About 453 grams of the composition is made.

The Cuisinart® is charged with 54% of the required sodium aluminosilicate (20% water hydrate). Sodium alkyl sulfate is then added as a low moisture surfactant paste (71% $C_{14-15}AS$, 20% water) at 140° F. (60° C.), during mixing. The AS paste serves as the doughy mass in this example and is not kneaded. The AS paste is added until the mixing mass appears meally and doughlike. Then additional aluminosilicate is added to further deagglomerate the mass. Further AS paste followed by aluminosilicate addition is repeated until the Cuisinart® is about ¾ full of material. The resulting particles are screened to obtain a through 14 Tyler mesh (about 1180 microns) on 65 Tyler mesh (about 208 microns) particle size distribution. The resulting granular detergent product has a bulk density of 770 g/L and excellent flow properties (no stickiness).

The detergent composition in Example III is prepared using an Eirich Intensive Mixer as described below. About 5 kg. of the composition is made.

The Eirich® Intensive Mixer is charged with low moisture sodium ($C_{14-15}$ alkyl sulfate (73% $C_{14-15}AS$, 11% water, 10% PED-8000) and sheared for 30 seconds. (This low moisture alkyl sulfate serves as the detergent dough mass described in Example II.) Sodium aluminosilicate (as zeolite) is then added to the low moisture alkyl sulfate during mixing at a rotor tip speed of 26.2 m/sec. The shearing action of the mixer, combined with the deagglomerating properties of the aluminosilicate results in the formation of granular detergent particles. The particles are then screened to obtain a similar particle size distribution as Example II. The resulting detergent granules have a bulk density of 661 g/L.

EXAMPLE IV

The following detergent composition is prepared according to Examples II and III. This composition makes admixable non-phosphate detergent builder particles.

| Ingredient | Weight Percent Finished Product | Dough |
|---|---|---|
| Tartrate mono- and disuccinate (about 80% monosuccinate) | 25.8 | 34.4 |
| Sodium polyacrylate (MW = 4500) | 19.4 | 25.9 |
| Sodium aluminosilicate (hydrated Zeolite A, ave. dia. 3-5 microns) | 19.0 | — |
| Sodium carbonate | 1.0 | — |
| Water | 27.5 | 30.0 |
| Miscellaneous (including impurities and unreacted material) | Balance | Balance |

Dough: Deagglomerating Agent Ratio 3:1

30% water system of tartrate and sodium polyacrylate exhibit properties similar to the doughy mass described in Examples II and III. This "polymer/builder" doughy mass is granulated using sodium aluminosilicate as described in Examples II and III.

What is claimed is:

1. A process for making detergent granules, comprising:
   (a) forming a doughy mass comprising a substantially uniform mixture of, by weight:
      (1) from about 5% to about 40% of water;
      (2) from about 20% to about 90% of an ingredient selected from the group consisting go anionic, zwitterionic, cationic, ampholytic, and nonionic surfactant; water-soluble organic polymer; detergent builder; and mixtures thereof;
      (3) form 0 to about 25% of a deagglomerating agent which is a fine powder having a mean particle size less than about 200 microns;
   (b) mixing the doughy mass with an effective amount of a deagglomerating agent, which is a fine powder having a mean particle size of less than about 200 microns, in a high shear mixer at a tip speed of greater than about 10 meters per second; wherein the ratio of doughy mass to deagglomerating agent added in step (b) is from about 9:1 to about 1:5; wherein said mixing is at a temperature between about 35° and 100° C.; and wherein steps (a) and (b) do not include crushing.

2. A process for making detergent granules according to claim 1 wherein, when said doughy mass in step (a) comprises more than one ingredient other than water, all ingredients added in step (a) are kneaded into said doughy mass at a temperature between about 40° C. and 100° C.

3. A process for making detergent granules according to claim 1 wherein said doughy mass comprises from 25% to about 60% of the ingredient in step (a) (2), and wherein said mixing is at a temperature between about 40° C. and 80° C.

4. A process for making detergent granules according to claim 3 wherein said doughy mass comprises from about 5% to about 15% water.

5. A process for making detergent granules according to claim 4 wherein less than about 5% by weight of said doughy mass in step (a) is made up of said deagglomerating agent.

6. A process for making detergent granules according to claim 5 wherein the ingredients of step (a) are kneaded together at a temperature between about 50° C. and 70° C.

7. A process for making detergent granules according to claim 1 wherein said ingredient in step (a) (2) is anionic surfactant.

8. A process for making detergent granules according to claim 1 wherein the ingredients in step (a) are a mixture of water, surfactant, water-soluble organic polymer and detergent builder.

9. A process for making detergent granules according to claim 7 wherein said anionic surfactant is $C_{10-18}$ alkyl sulfate.

10. A process for making detergent granules according to claim 8 wherein said surfactant comprises a mixture of $C_{10-18}$ alkyl sulfate and $C_{10-18}$ linear alkylbenzene sulfonate.

11. A process for making detergent granules according to claim 10 wherein said surfactant further comprises a condensation product of $C_{12-15}$ alcohol with from about 5 to about 20 moles of ethylene oxide per mole of alcohol.

12. A process for making detergent granules according to claim 1 wherein said ingredient in step (a) (2) comprises a water-soluble organic polymer selected from the group consisting of polyacrylate of molecular weight between about 4,000 and 100,000; and polyethylene glycol of molecular weight between about 2,000 and 50,000.

13. A process for making detergent granules according to claim 10 wherein said water-soluble organic polymer is polyethylene glycol of molecular weight between about 4,000 and 10,000; and wherein the ratio of $C_{10-18}$ alkyl sulfate to $C_{10-18}$ linear alkylbenzene sulfonate is about 2:1 to 1:2.

14. A process for making detergent granules according to claim 1 wherein said ingredient in step (a) (2) comprises a detergent builder selected from the group consisting of phosphates, carbonates, silicates, $C_{10-18}$ fatty acids, polycarboxylates, and mixtures thereof.

15. A process for making detergent granules according to claim 13 wherein said ingredient builder is selected from the group consisting of sodium tripolyphosphate, tetrasodium pyrophosphate, citrate acid, tartrate succinate, sodium silicate, and mixtures thereof.

16. A process for making detergent granules according to claim 1 wherein said deagglomerating agent is selected from the group consisting of aluminosilicate, powdered carbonate, powdered tripolyphosphate, powdered tetrasodium pyrophosphate, citrate, sulfate, and mixtures thereof.

17. A process for making detergent granules according to claim 16 wherein said deagglomerating agent is a fine powder with a mean particle size of less than about 100 microns.

18. A process for making detergent granules according to claim 17 wherein said doughy mass of step (a) comprises less than about 5% by weight of the deagglomerating agent.

19. A process for making detergent granules according to claim 18 wherein said deagglomerating agent is sodium aluminosilicate.

20. A process for making detergent granules according to claim 19 wherein the ratio of dough mass to sodium aluminosilicate is from about 4:1 to about 1:2.

21. A process for making detergent granules according to claim 20 wherein said high shear mixer has a tip speed of between about 20 and 35 meters per second.

22. A process for making detergent granules according to claim 1, said detergent granules comprising from 0 to about 50%, by weight of the finished product, of additional detergent ingredients selected from the group consisting of water-soluble neutral or alkaline salt, suds control agent, soil suspending agent, soil release agent, germicide, pH adjusting agent, chelating agent, smectite clay, enzyme-stabilizing agent, perfume, and fluorescent brightener.

23. Detergent granules made according to the process of claim 1.

24. Detergent granules made according to the process of claim 11.

25. Detergent granules made according to the process of claim 21.

* * * * *